United States Patent [19]

Gurevich

[11] Patent Number: 4,926,153

[45] Date of Patent: May 15, 1990

[54] CERAMIC FUSE WIRE COATING

[75] Inventor: Leon Gurevich, St. Louis, Mo.

[73] Assignee: Cooper Industries, Inc., Houston, Tex.

[21] Appl. No.: 360,432

[22] Filed: Jun. 2, 1989

[51] Int. Cl.[5] ..... H01H 85/38; H01H 85/44

[52] U.S. Cl. ..... 337/273; 337/276

[58] Field of Search ..... 337/273, 276, 278, 279, 337/280, 281; 106/84

[56] References Cited

U.S. PATENT DOCUMENTS

| | | | |
|---|---|---|---|
| 680,968 | 8/1901 | Downes . | |
| 890,255 | 6/1908 | Weston et al. . | |
| 919,744 | 4/1909 | Murray . | |
| 924,093 | 6/1909 | Murray . | |
| 961,175 | 6/1910 | Smith . | |
| 982,738 | 1/1911 | Moellendorf . | |
| 1,463,885 | 8/1923 | Goodwin . | |
| 1,470,440 | 10/1923 | Goodridge . | |
| 2,007,313 | 7/1935 | Sherwood . | |
| 2,337,937 | 12/1943 | Serfling et al. . | |
| 2,688,061 | 8/1954 | Kozacka . | |
| 2,877,321 | 3/1959 | Jacobs, Jr. . | |
| 2,972,031 | 2/1961 | Cox . | |
| 3,486,155 | 12/1969 | McCaughna | 337/231 |
| 3,962,668 | 6/1976 | Knapp, Jr. | 337/228 |
| 4,612,529 | 9/1986 | Gurevich et al. | 337/260 |
| 4,751,489 | 6/1988 | Spaunhorst | 337/260 |
| 4,771,260 | 9/1988 | Gurevich | 337/273 |

*Primary Examiner*—H. Broome

*Attorney, Agent, or Firm*—Donald Verplancken

[57] ABSTRACT

A ceramic coating for a subminiature fuse includes sodium silicate and silicon dioxide applied over a subminiature fuse wire in slurry form. The coating gives the fuse arc quenching properties.

3 Claims, 1 Drawing Sheet

CERAMIC FUSE WIRE COATING

BACKGROUND OF THE INVENTION

This invention relates to the field of circuit interruption devices, more particularly microfuses, and more particularly still arc quenching fillers used to suppress arcing during a microfuse opening cycle.

Microfuses are used to interrupt the electrical circuit path in printed circuits. The microfuse must be physically small, to fit within the geometric boundaries of a circuit board, and be capable of interrupting a circuit in a very short time period to protect delicate transistors and related miniature electronic components. The typical microfuse is approximately three hundred thousandths of an inch long and has a tubular cross-section approximately one hundred and twenty five thousandths thick. To fulfill circuit interrupting functions, the fuse must have arc quenching capabilities.

Arc quenching fuses have been known in the art for many years, and are commonly used in high voltage applications. One such fuse is shown in U.S. Pat. No. 2,007,313, to Sherwood, that discloses a magnesium filler material which performs an arc quenching function. These fillers have a large grain size, typically 25 micron or larger. Such fillers are too large for incorporation into the small envelope of the body of the microfuse. Likewise, they would tend to break the delicate fuse wire used in the microfuse.

Commercial ceramic arc quenching media are available for use with microfuses. One such media used by the Bussmann Division of Cooper Industries, is a combination of silica, magnesia, zirconia and a filler material. One such media is manufactured by Remco Products, Inc. of Ossining, N.Y. The media is applied as a liquid slurry to a ceramic substrate or wafer having a fuse wire attached to opposed metallized areas thereon. The fuse wire may be attached to the metallized areas by ultrasonic bonding, so that the area of the wire between the metallized areas does not touch the substrate. The slurry is allowed to dry, and is then cured in an oven at elevated temperatures to drive off excess water.

This prior art ceramic media has several processing and performance limitations. First, the media tends to crack and shrink during the drying and curing cycles. The shrinkage tends to form voids in the media adjacent the fuse wire. Likewise, the media composition itself appears to create interstitial voids adjacent the fuse wire. Both the cracks and the voids, when adjacent the fuse wire, may lead to premature circuit interruption and undesirable interruption characteristics. Further, the media has insufficient adhesion properties, and thus tends to peel away from the substrate during processing, thereby destroying the fuse.

The prior art ceramic arc quenching media also has limited applicability to inductive circuits. Where a power factor of 94% is encountered, the arc voltage which occurs during fuse opening can be two to three times the rated voltage of the fuse. In fuses employing known ceramic arc quenching media, arcs having enhanced voltages induced by the inductive components of the circuit may cause pressure to build adjacent the fuse wire which is beyond the capability of the media to withstand causing the fuse to explode. No known media for microfuses will yield adequate arc quenching non-catastrophic results in an inductive circuit, i.e., one with a percentage power factor below one hundred percent. The prior art media also exhibits low post-opening resistance, which can allow a leakage current to pass across the open fuse.

The present invention overcomes these deficiencies of the prior art.

SUMMARY OF THE INVENTION

The present invention is an improved arc quenching coating for a microfuse comprised of sixty percent 240 mesh silicon dioxide and forty percent sodium silicate diluted with one part water to 9 parts sodium silicate. This mixture forms a slurry which is then applied to a fuse wire-substrate subassembly in droplet form and allowed to dry thereon. After drying, the material is stage cured in an oven to drive off the water in the mixture. After curing, a plastic coating may be applied to the fuse by injection or insert molding.

The ceramic coating of the present invention dries quickly and eliminates the shrinkage, cracking and presence of voids found in the prior art coatings. Further, the material has lower thermal conductivity permitting a faster opening of the fuse, better arc extinguishing capability, and superior mechanical strength which prevents catastrophic fuse, explosions. The coating will withstand interruptions 94% power factor or higher. Finally, the material exhibits high afterblow resistance, which reduces the likelihood of post opening leakage currents.

Other objects and advantages of the present invention will become apparent from the following description and drawings.

BRIEF DESCRIPTION OF THE DRAWINGS

For a detailed description of the invention, reference will now be made to the accompanying drawings, wherein.

DESCRIPTION OF THE PREFERRED EMBODIMENT

Figure 1:
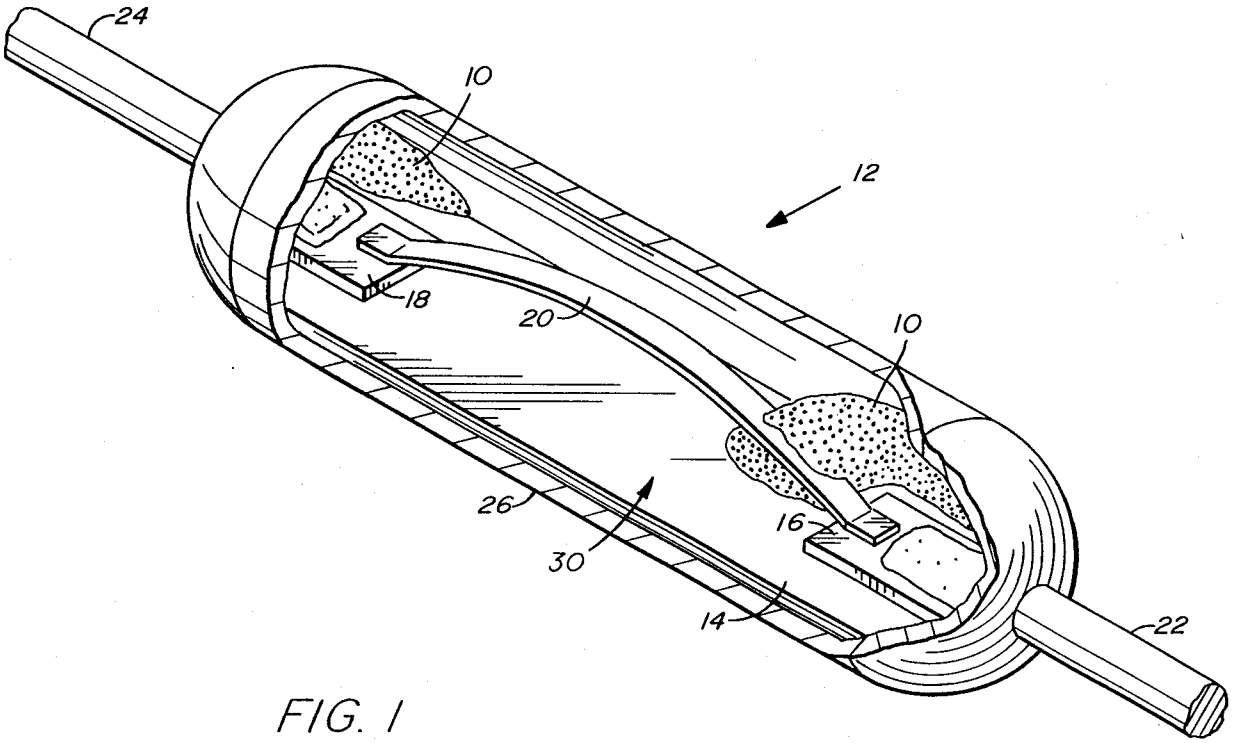
FIG. 1 is a partial cutaway perspective view of a fuse including the improved ceramic coating of the present invention.

Referring initially to FIG. 1, the improved ceramic coating 10 is disposed within the body of fuse 12. Coating 10 is prepared from a combination of silicon dioxide, sodium silicate and water. The fuse 12 includes a ceramic substrate 14 having opposed metallized areas 16, 18. A fuse wire 20 extends between the metallized areas 16, 18 and forms an electrically conductive link therebetween. Leads 22, 24 are in electrical contact with metallized areas 16, 18 and project longitudinally outward from substrate 14. The combination of substrate 14, fuse wire 20, and leads 22, 24 forms a fuse subassembly 30 for easy handling. Ceramic coating 10 envelopes and covers substrate 14 and fusing wire 20. A plastic coating 26 envelopes and covers the ceramic coating such that only the ends of leads 22, 24 are exposed on fuse 12.

The ceramic coating 10 is preferably comprised of 240 mesh silicon dioxide floated powder in combination with sodium silicate which has been diluted in the ratio of nine parts sodium silicate to one part deionized water. The silicon dioxide powder may be purchased from Fisher Scientific Co. of Pittsburgh, Pa. in the required size, or may be sorted by screening with the proper size mesh screen after purchase. Although silicon dioxide powder having a maximum size of 240 mesh is preferred, the ceramic coating will exhibit the enhanced properties where the silicon dioxide powder has a maximum size between 120 and 300 mesh. The sodium silicate may be purchased from PQ Corporation, Industrial Chemical Division, of Valley Forge, Pa. as Type "E" sodium silicate, having a mole weight ratio of 3.22 mole silicon dioxide to 1 mole sodium oxide. The sodium silicate is diluted with one part deionized water for every nine parts sodium silicate before being mixed with the silicon dioxide. The ceramic coating is preferably comprised of forty percent sodium silicate and sixty percent silicon dioxide. The coating 10 is manufactured by pouring the proper proportion of watered sodium silicate into the proper proportion of silicon dioxide powder. The addition of the deionized water to the sodium silicate forms a diluted slurry, which, when mixed with the silicon dioxide forms a ceramic slurry. This ceramic slurry is thoroughly mixed to ensure dispersal of each component therein.

It should be appreciated that the sodium silicate material is a liquid prior to addition of the deionized water. It has been found that a sodium silicate/silicon dioxide slurry may be manufactured without the addition of deionized water, and that the deletion of this step does not adversely affect the performance of the ceramic coating after application on the fuse.

Once the ceramic slurry is mixed, it may be disposed on the fuse subassembly 30 by placing a drop of the slurry thereon. The drop should be large enough to coat the substrate 14 to a thickness of twenty to fifty thousandths of an inch. It has been found that the ceramic slurry has a sufficient combination of capillary action and surface tension properties to allow the ceramic slurry to migrate around the sides of substrate. After the coating 10 is placed on the subassembly 30, it is allowed to solidify. The slurry of the present invention has been found to solidify in approximately fifteen minutes.

After the ceramic slurry has solidified, the fuse subassembly is allowed to dry at room temperature for a period of sixteen to twenty-four hours. Following this, a group of fuse subassemblies having the ceramic coating thereon, preferably one thousand to fifteen hundred subassemblies, are cured in an oven to drive off all the moisture in the slurry. To properly cure the solidified ceramic coating, the fuse subassemblies are cured in an oven at a series of elevated curing temperatures. The first stage of curing is performed at fifty degrees centigrade for four hours, after which the oven temperature is increased at intervals of approximately thirty degrees per hour until a steady state temperature of ninety three degrees centigrade is reached. The oven is held at this temperature for four hours, and is then again increased at the same rate until a steady state temperature of one hundred twenty degrees is reached. This temperature is held for four hours, after which the temperature is again raised at a rate of thirty degrees per hour until one hundred and fifty degrees is reached. This temperature is held for four hours, at which time heat is removed and the subassemblies are allowed to cool to room temperature. The temperature is increased slowly in staged intervals to prevent the ceramic coating from cracking. It has been found that if the temperature is increased too rapidly from one curing temperature to the next, cracks and voids will appear in the coating. At this point, a plastic coating may be formed around the fuse by injection or insert molding or other process to complete the production of fuse 12.

The curing cycle may be modified if fewer subassemblies are cured simultaneously. For example, where only two or three hundred subassemblies are being cured the duration of time at each curing temperature is reduced to only an hour.

The percentages and sizes of the components of the ceramic coating may be varied within limits without eliminating the advantages of the present invention. It has been found that the ratio of silicon dioxide to sodium silicate may be varied to allow between forty and eighty percent silicon dioxide by weight with a corresponding amount of sodium silicate to make up one hundred percent of the mixture of the components.

The use of the silicon dioxide/sodium silicate combination has been found to have acceptable interruption capacity in circuits having a power factor of 94% or higher. However, the ceramic coating will still exhibit some of the enhanced power factor interruption capacity with the addition of up to twenty percent filler materials, such as alumina, zirconia or magnesia. The use of fillers such as these reduces the power factor interruption capacity somewhat, but the resulting ceramic coated fuse still has the capability to interrupt circuits with a power factor of up to 97%. The prior art fuse had unacceptable performance in any inductive circuit, i.e., any circuit with a power factor in the 99% to 94% power factor range.

It has been found that the ceramic coating of the present invention results in a fuse having substantially better short circuit performance in combination with enhanced manufacturability. The improved coating is capable of arc quenching interruption at up to 94% power factor at 50 amps and 125V AC. The coating dries more quickly than the prior art coating, and yields a coating without cracks or voids. The adhesion properties of the coating are far greater than the prior art coating and, as a result, very few fuses suffer from coating peeling which was present in the prior art. Further, the ceramic coating has a higher strength as compared to the prior art compound, which helps keep the fuse intact at high power interruptions. The coating also has a lower thermal conductivity than prior art compounds, which increases the temperature of the fusing link during circuit interruption, causing a quicker interruption during circuit overload conditions. Finally, the improved ceramic coating has greater afterblow resistance than the prior art.

While preferred and alternative embodiments of the invention have been described, those skilled in the art may recognize alternative uses or components for the compound of the present invention. For example, the improved ceramic coating may be employed with both axial or surface mount miniature fuse designs. A surface mount fuse typically includes flattened leads which project outward from the opposed sides of the fuse body and are bent around the side to form terminals on the base of the fuse body. Likewise, the coating may be used with fusing links other than wire, such as a metallized chip having thick film or thin film metalizations, or a ribbon link. These fusing links are all compatible with the improved ceramic coating and when used with the improved ceramic coating, yield fuses with enhanced performance.

I claim:

1. A fuse, comprising:

a fusing link disposed between conductive areas and in electric engagement therewith;

leads attached to said conductive areas and projecting therefrom;

a ceramic coating enveloping said fusing link including forty to eighty percent silicon dioxide having a maximum size of 120 mesh in a mixture with sufficient sodium silicate to make up one hundred percent of said ceramic coating; and a plastic coating encapsulating said ceramic coating and substrate.

2. The fuse of claim 1, wherein said silicon dioxide is 240 mesh.

3. The fuse of claim 1, wherein said sodium silicate has a mole weight ratio of 3.22 parts silicon dioxide to one mole sodium oxide.

* * * * *

UNITED STATES PATENT AND TRADEMARK OFFICE

CERTIFICATE OF CORRECTION

PATENT NO. : 4,926,153
DATED : May 15, 1990
INVENTOR(S) : Leon Gurevich

It is certified that error appears in the above—identified patent and that said Letters Patent is hereby corrected as shown below:

In Claim 1, column 4, line 63, after the word "areas" insert --on a substrate--.

Signed and Sealed this

Tenth Day of November, 1992

*Attest:*

DOUGLAS B. COMER

*Attesting Officer*

*Acting Commissioner of Patents and Trademarks*